US012678003B2

(12) United States Patent
Foss et al.

(10) Patent No.: US 12,678,003 B2
(45) Date of Patent: Jul. 14, 2026

(54) ROBOTIC SURFACE TREATING SYSTEM

(71) Applicant: Dyson Technology Limited, Wiltshire (GB)

(72) Inventors: Samuel Finistair da Conceicao Foss, Perth (AU); Andrew James Shaw, Swindon (GB); David Stuart Cole, Bath (GB)

(73) Assignee: Dyson Technology Limited, Malmesbury (GB)

( * ) Notice: Subject to any disclaimer, the term of this patent is extended or adjusted under 35 U.S.C. 154(b) by 138 days.

(21) Appl. No.: 18/035,388

(22) PCT Filed: Oct. 20, 2021

(86) PCT No.: PCT/GB2021/052716
§ 371 (c)(1),
(2) Date: May 4, 2023

(87) PCT Pub. No.: WO2022/096855
PCT Pub. Date: May 12, 2022

(65) Prior Publication Data

US 2023/0414051 A1 Dec. 28, 2023

(30) Foreign Application Priority Data

Nov. 6, 2020 (GB) ..... 2017581

(51) Int. Cl.
*A47L 9/00* (2006.01)
*A47L 9/24* (2006.01)
(Continued)

(52) U.S. Cl.
CPC ..... *A47L 9/242* (2013.01); *A47L 9/009* (2013.01); *A47L 9/248* (2013.01); *A47L 5/225* (2013.01); *A47L 5/24* (2013.01); *A47L 2201/00* (2013.01)

(58) Field of Classification Search
CPC ... B25J 9/104; B25J 9/042; B25J 9/021; B25J 9/0003
See application file for complete search history.

(56) References Cited

U.S. PATENT DOCUMENTS 5,148,573 A 9/1992 Killian et al.
5,413,454 A * 5/1995 Movsesian ..... B25J 9/046 414/722
(Continued)

FOREIGN PATENT DOCUMENTS

AU 2014200522 A1 2/2014
CN 101568286 A 10/2009
(Continued)

OTHER PUBLICATIONS

Examination Report received for GB Application No. 2017567.5, mailed on Feb. 13, 2023, 2 pages.
(Continued)

*Primary Examiner* — Gregory Robert Weber
(74) *Attorney, Agent, or Firm* — Tucker Ellis LLP; Michael G. Craig

(57) ABSTRACT

A vacuum cleaning system including a robotic unit including a main body, a traction arrangement defining a ground plane and an articulated arm. The articulated arm includes an upper arm section and a lower arm section, wherein the upper arm section is attached to the main body at a shoulder joint, and wherein the lower arm section is attached to the upper arm section at an elbow joint, and an end effector is defined at a distal end of the lower arm section. The upper arm section includes a pair of generally parallel arm members which are connected between the shoulder joint and the elbow joint and which are configured to define a yoke at the elbow joint at which the lower arm section is connected. The vacuum cleaning system equipped with a robotic arm that is able to bend and flex due to the pivotable upper and lower
(Continued)

arm portions and has flexibility in how the robotic arm is driven and how suction is routed through the machine.

15 Claims, 12 Drawing Sheets

(51) Int. Cl.
*A47L 5/22* (2006.01)
*A47L 5/24* (2006.01)

(56) References Cited

U.S. PATENT DOCUMENTS

| | | | |
|---|---|---|---|
| 5,497,529 | A | 3/1996 | Boesi |
| 5,709,007 | A | 1/1998 | Chiang |
| 7,113,847 | B2 | 9/2006 | Chmura et al. |
| 8,079,113 | B2 | 12/2011 | Chong et al. |
| 9,173,531 | B2 | 11/2015 | Chiu et al. |
| 9,827,677 | B1 | 11/2017 | Gilbertson et al. |
| 10,173,323 | B2 * | 1/2019 | Carlisle ..... B25J 19/063 |
| 10,638,898 | B2 | 5/2020 | Chiu et al. |
| 11,324,373 | B2 | 5/2022 | Lee et al. |
| 2007/0042624 | A1 | 2/2007 | Gerving et al. |
| 2009/0133720 | A1 | 5/2009 | Van Den Bogert |
| 2010/0256812 | A1 | 10/2010 | Tsusaka et al. |
| 2012/0189507 | A1 | 7/2012 | Ko |
| 2012/0222263 | A1 | 9/2012 | Conrad |
| 2013/0269148 | A1 | 10/2013 | Chiu et al. |
| 2013/0330162 | A1 * | 12/2013 | Horinouchi ..... B25J 15/0028 414/730 |
| 2014/0007368 | A1 | 1/2014 | Larson |
| 2014/0289998 | A1 | 10/2014 | Wang |
| 2016/0174785 | A1 | 6/2016 | Conrad |
| 2017/0079490 | A1 | 3/2017 | Dimbylow |
| 2018/0213986 | A1 | 8/2018 | Chiu et al. |
| 2018/0317725 | A1 | 11/2018 | Lee et al. |
| 2018/0354136 | A1 | 12/2018 | Carlisle et al. |
| 2019/0246858 | A1 | 8/2019 | Karasikov et al. |
| 2019/0282053 | A1 | 9/2019 | Tian et al. |
| 2019/0320865 | A1 | 10/2019 | Brown et al. |
| 2020/0001468 | A1 | 1/2020 | Song et al. |
| 2020/0205371 | A1 | 7/2020 | Kuo et al. |
| 2020/0298415 | A1 | 9/2020 | Sun et al. |

FOREIGN PATENT DOCUMENTS

| | | | |
|---|---|---|---|
| CN | 101972128 | A | 2/2011 |
| CN | 201871310 | U | 6/2011 |
| CN | 203506595 | U | 4/2014 |
| CN | 104720695 | A | 6/2015 |
| CN | 105746481 | A | 7/2016 |
| CN | 205458454 | U | 8/2016 |
| CN | 205568870 | U | 9/2016 |
| CN | 205729239 | U | 11/2016 |
| CN | 106426198 | A | 2/2017 |
| CN | 106532375 | A | 3/2017 |
| CN | 106821162 | A | 6/2017 |
| CN | 206403702 | U | 8/2017 |
| CN | 107137012 | A | 9/2017 |
| CN | 107334420 | A | 11/2017 |
| CN | 107457234 | A | 12/2017 |
| CN | 108403013 | A | 8/2018 |
| CN | 108542311 | A | 9/2018 |
| CN | 108577686 | A | 9/2018 |
| CN | 109157170 | A | 1/2019 |
| CN | 109623774 | A | 4/2019 |
| CN | 208864220 | U | 5/2019 |
| CN | 109984669 | A | 7/2019 |
| CN | 209301027 | U | 8/2019 |
| CN | 209574563 | U * | 11/2019 |
| CN | 210871310 | U | 6/2020 |
| CN | 111839363 | A | 10/2020 |
| CN | 211749321 | U | 10/2020 |
| CN | 115151175 | A | 10/2022 |
| DE | 4214378 | C1 | 8/1993 |
| DE | 4425924 | A1 | 1/1996 |
| DE | 10000407 | A1 | 7/2001 |
| DE | 102015210255 | A1 | 12/2016 |
| EP | 1987407 | A1 | 11/2008 |
| EP | 2649920 | A1 | 10/2013 |
| EP | 2711255 | A1 | 3/2014 |
| EP | 3015179 | A1 | 5/2016 |
| EP | 3342324 | A1 | 7/2018 |
| EP | 3357391 | A1 | 8/2018 |
| EP | 3476265 | A1 | 5/2019 |
| GB | 1416221 | A | 12/1975 |
| JP | S5993287 | A | 5/1984 |
| JP | 04-295323 | A | 10/1992 |
| JP | 10-118963 | A | 5/1998 |
| JP | H115067 | A | 1/1999 |
| JP | 2001238828 | A | 9/2001 |
| JP | 2003265380 | A | 9/2003 |
| JP | 2006-043302 | A | 2/2006 |
| JP | 2007-282834 | A | 11/2007 |
| JP | 4295323 | B2 | 7/2009 |
| JP | 4512672 | B2 | 7/2010 |
| JP | 3187463 | U | 11/2013 |
| JP | 2014-144051 | A | 8/2014 |
| KR | 10-0283863 | B1 | 3/2001 |
| KR | 10-2003-0086035 | A | 11/2003 |
| KR | 10-2004-0084359 | A | 10/2004 |
| KR | 10-0596479 | B1 | 7/2006 |
| KR | 20070103248 | A | 10/2007 |
| KR | 10-1015465 | B1 | 2/2011 |
| KR | 20120060659 | A | 6/2012 |
| KR | 10-1208979 | B1 | 12/2012 |
| KR | 10-2018-0025794 | A | 3/2018 |
| KR | 10-1878142 | B1 | 8/2018 |
| TW | M468289 | U | 12/2013 |
| WO | 93/22108 | A1 | 11/1993 |
| WO | 96/03259 | A1 | 2/1996 |
| WO | 1996024000 | A1 | 8/1996 |
| WO | 2008/142642 | A1 | 11/2008 |
| WO | 2010/016210 | A1 | 2/2010 |
| WO | 2013099104 | A1 | 7/2013 |
| WO | 2014/207274 | A1 | 12/2014 |
| WO | 2017073955 | A1 | 5/2017 |
| WO | 2017/157302 | A1 | 9/2017 |
| WO | 2020095046 | A1 | 5/2020 |
| WO | 2020126830 | A1 | 6/2020 |
| WO | 2022/096846 | A1 | 5/2022 |
| WO | 2022/096852 | A1 | 5/2022 |
| WO | 2022/096854 | A1 | 5/2022 |
| WO | 2022/096855 | A1 | 5/2022 |

OTHER PUBLICATIONS

Examination Report received for GB Application No. 2017577.4, mailed on Feb. 13, 2023, 1 page.

Examination Report received for GB Application No. 2017579.0, mailed on Feb. 14, 2023, 1 pages.

Examination Report received for GB Application No. 2017581.6, mailed on Feb. 14, 2023, 1 page.

International Search Report and Written Opinion received for PCT Patent Application No. PCT/GB2021/052717, mailed on Jan. 24, 2022, 11 pages.

International Search Report and Written Opinion received for PCT Patent Application No. PCT/GB2021/052707, mailed on Jan. 28, 2022, 11 pages.

International Search Report and Written Opinion received for PCT Patent Application No. PCT/GB2021/052712, mailed on Jan. 20, 2022, 13 pages.

International Search Report and Written Opinion received for PCT Patent Application No. PCT/GB2021/052713, mailed on Jan. 24, 2022, 13 pages.

International Search Report and Written Opinion received for PCT Patent Application No. PCT/GB2021/052714, mailed on Jan. 21, 2022, 11 pages.

International Search Report and Written Opinion received for PCT Patent Application No. PCT/GB2021/052715, mailed on Jan. 19, 2022, 9 pages.

(56) References Cited

OTHER PUBLICATIONS

International Search Report and Written Opinion received for PCT Patent Application No. PCT/GB2021/052716, mailed on Jan. 27, 2022, 11 pages.
Search Report received for GB Application No. 2017567.5, mailed on Apr. 15, 2021, 2 pages.
Search Report received for GB Application No. 2017581.6, mailed on Apr. 16, 2021, 1 page.
Search Report received for GB Application No. 2017577.4, mailed on Apr. 13, 2021, 1 page.
Search Report received for GB Application No. 2017579.0, mailed on Apr. 14, 2021, 1 page.
Search Report received for GB Application No. 2017582.4, mailed on Apr. 14, 2021, 1 page.

* cited by examiner

ROBOTIC SURFACE TREATING SYSTEM

RELATED APPLICATION DATA

This application is the National Stage of International Application No. PCT/GB2021/052716 filed Oct. 20, 2021, and claims benefit of United Kingdom Application No. 2017581.6 filed Nov. 6, 2020, each of which are herein incorporated by reference in their entirety.

TECHNICAL FIELD

The invention relates to a robotic surface treating system, and particularly though not exclusively to a robotic vacuum cleaning system.

BACKGROUND

The robotic vacuum cleaner market has grown hugely over the past decade. Changes in lifestyle, increased disposable income, urbanisation and growing focus on labour-saving devices are some of the factors that have boosted market growth, and the trend seems to be set to continue.

Whilst the robotisation of vacuum cleaners has seen more products enter the market, the form factor of such robots has not tended to diversify. Generally, robotic vacuum cleaners available on the market are discoidal in shape, with a low height so they can travel underneath furniture in order to clean there. The main technological developments have focussed on improving navigational capabilities to improve autonomy, bin emptying systems and run time. In the main, however, the robotic vacuum cleaner market includes many generally circular machines that offer very little in terms of differentiation.

Some effort has been made to improve the functionality of robot vacuum cleaners to cope with demanding environments. For example, US2020/001468 describes a robotic cylinder-style machine which has a cleaner head that can locomote separately. The cleaner head can therefore driver itself away from the main body of the machine to as to stretch underneath furniture.

US2018/317725 and US2010/0256812 describe discoidal robots which are equipped with robotic arms. However, neither of these examples appears to be a practical application, and the utility of the robotic arm in each case seems to be limited.

It is against this background that the embodiments of the invention have been devised.

SUMMARY OF THE INVENTION

According to a first aspect of the invention, there is provided a vacuum cleaning system comprising a robotic unit comprising a main body, a traction arrangement defining a ground plane and an articulated arm. The articulated arm comprises an upper arm section and a lower arm section, wherein the upper arm section is attached to the main body at a shoulder joint, and wherein the lower arm section is attached to the upper arm section at an elbow joint, and an end effector is defined at a distal end of the lower arm section, wherein the upper arm section comprises a pair of generally parallel arm members which are connected between the shoulder joint and the elbow joint and which are configured to define a yoke at the elbow joint at which the lower arm section is connected.

The invention thus provides a robotic vacuum cleaning system equipped with a robotic arm in a beneficial configuration that provides flexibility in how the robotic arm is driven and how suction is routed through the machine, and/or offers increased arm strength or rigidity (for instance torsional strength/rigidity).

The pair of parallel arm members may extend the entire length of the upper arm section between the elbow joint and the shoulder joint. In other examples, however, the pair of parallel arm members extend over at least 25%, or 50% or even 75% of the length of the upper arm section between the elbow joint and the shoulder joint.

The pair of parallel arm members may comprise two struts, each of which has a first end connected to the shoulder joint of the robotic unit and a second end that together defines the yoke at the elbow joint. A drive mechanism may be provided in the main body of the robotic unit which is configured to cause to articulated arm to pivot at the elbow joint. In such a configuration the shoulder joint may be passive. In other examples, the elbow joint may be driven with a respective drive motor located at the joint. A transmission of the drive mechanism may extend at least in part along one of the parallel arm members. A suction conduit may extend at least in part along the other of the parallel arm members.

The drive mechanism may also be configured to drive movement of the end effector. Therefore the drive mechanism provides multiple degrees of freedom for the robotic arm, despite having drive motors located only in the main body, in a particular example.

The articulated arm may be configured so that in a stowed position, the upper arm section and the lower arm section are substantially parallel to one another, and may extend in a direction that is transverse to the ground plane, thereby providing a particularly neat storage solution for the machine.

The articulated arm may also be movable from the stowed position to a fully deployed position, wherein in the fully deployed position the lower arm section extends substantially parallel to the ground plane. Also, in the fully deployed position a portion of the upper arm section may extend substantially parallel to the ground plane. This provides a useful extended reach for the articulated arm.

The articulated arm may be controlled by an on-board controller in communication with a sensor system.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

The above and other aspects of the invention will now be described, by way of example only, with reference to the accompanying drawings, in which:

FIG. 6*a* shows the handheld vacuum cleaner docked on the robotic drive module, and FIG. 6*b* shows the handheld vacuum cleaner separated from the robotic drive module;

FIGS. 7*a* and 7*b* show comparative views of the vacuum cleaning system, in which FIG. 7*b* shows a partially stripped configuration to emphasise the airflow path through the machine;

Note that features that are the same or similar in different drawings are denoted by like reference signs.

Specific Description

A specific embodiment of the invention will now be described in which numerous features will be discussed in detail in order to provide a thorough understanding of the inventive concept as defined in the claims. However, it will be apparent to the skilled person that the invention may be put into effect without the specific details and that in some instances, well known methods, techniques and structures have not been described in detail in order not to obscure the invention unnecessarily.

In overview, the invention provides a novel type of robotically-driven surface treating system, which is embodied in the illustrated examples as a vacuum cleaning system. The cleaning system is a hybrid design which comprises a robotic drive unit or module, and a handheld vacuum cleaner that is removably attachable to the robotic drive module. Moreover, the robotic drive module is equipped with a robotic arm which carries a cleaning tool or head on its distal end. The robotic arm therefore provides the robotic cleaning system with an extended reach so that it can clean under low-lying furniture. A convenient feature of the system is that the cleaning tool which is attachable to the distal end of the robotic arm, can also be attached to the handheld vacuum cleaner, either directly or via a wand extension tube. The cleaning system is therefore particularly convenient because a user can use the handheld vacuum cleaner to carry out spot-cleaning or more wide-spread cleaning tasks, e.g. when it is in stick-vac mode, but then the cleaner head can be installed onto the robotic drive module so that it can carry out autonomous cleaning tasks on a schedule that suits the user. Further features and advantages will become apparent from the discussion that follows.

Figure 1:
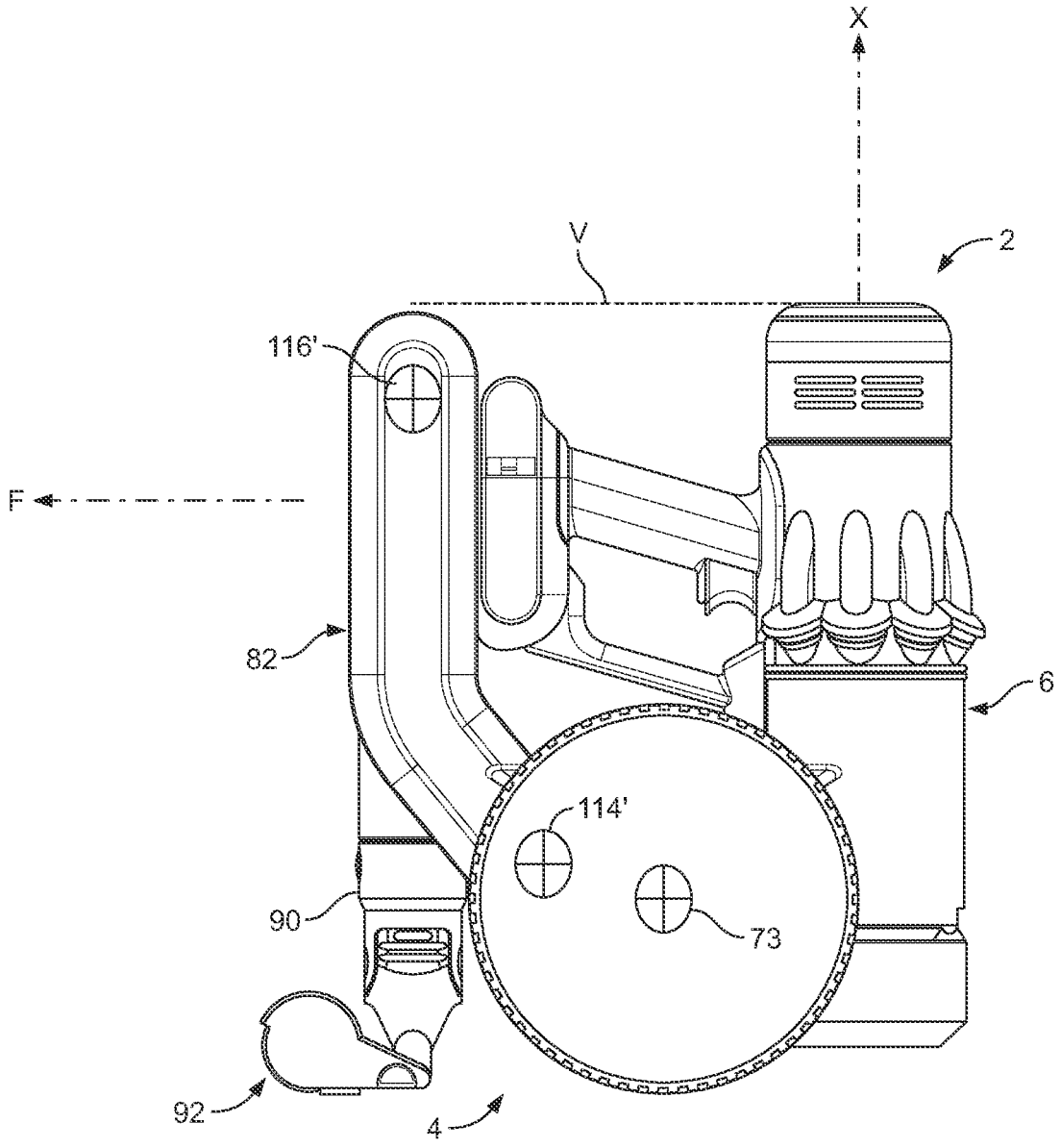
FIG. 1 is a is a side view of a vacuum cleaning system, in accordance with an example of the invention, comprising a robotic drive module having a robotic arm, and a handheld vacuum cleaner mounted on the robotic drive module.
Figure 2:
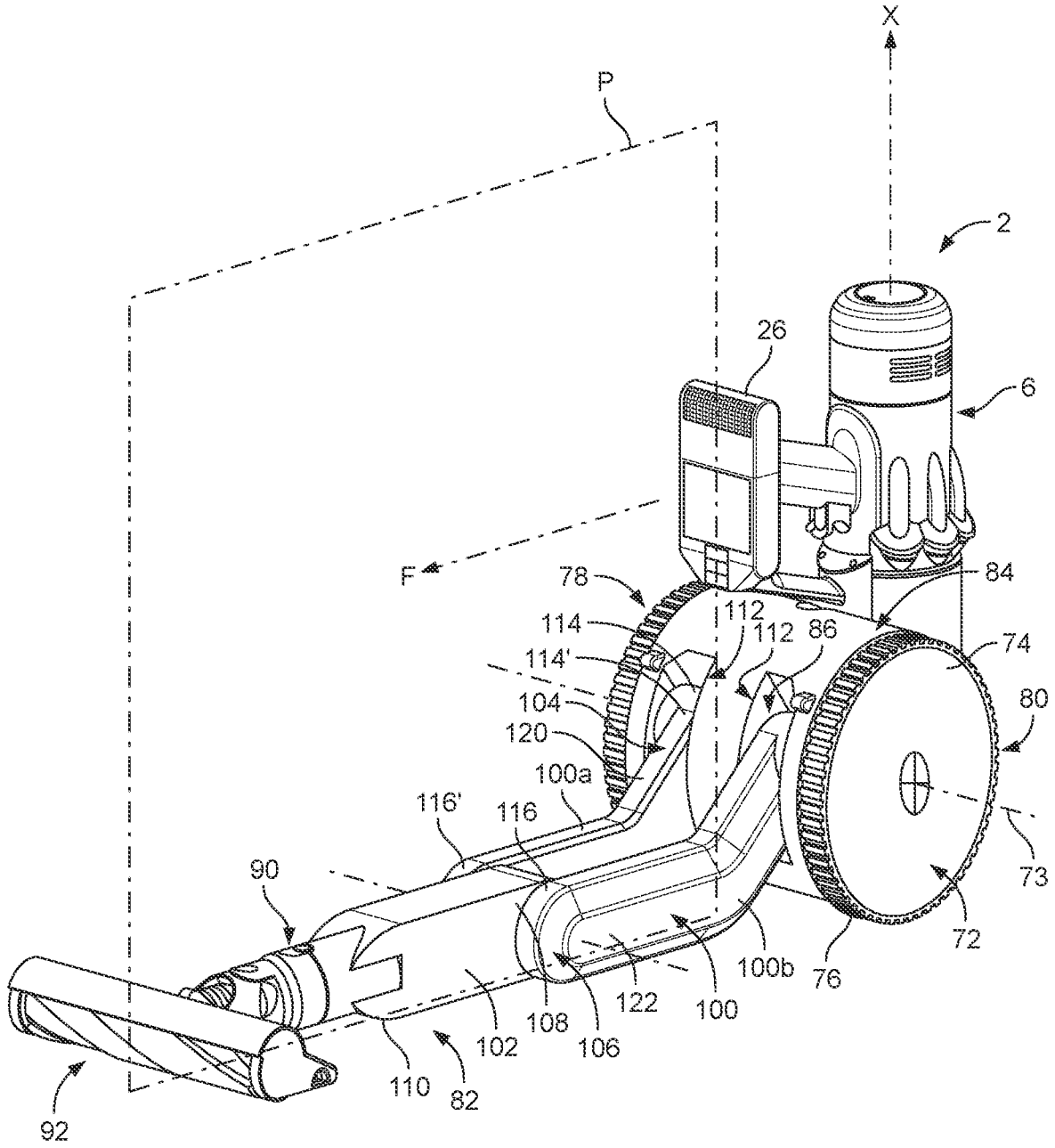
FIG. 2 is a perspective view of the vacuum cleaning system of FIG. 1, with the robotic arm in a fully deployed state.
Figure 3:
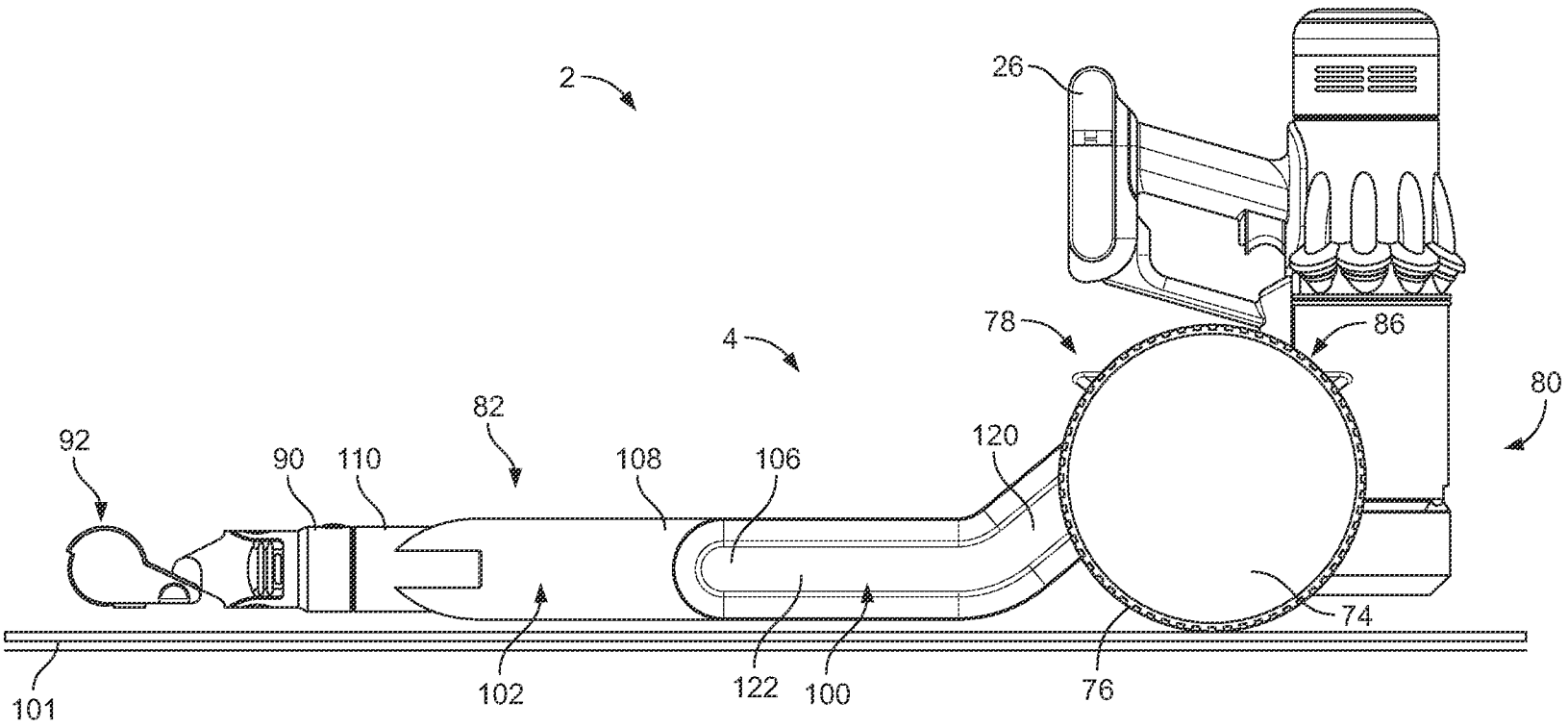
FIG. 3 is a side view of the vacuum cleaning system, with the arm in a deployed state like that in FIG. 2.
Figure 6B:
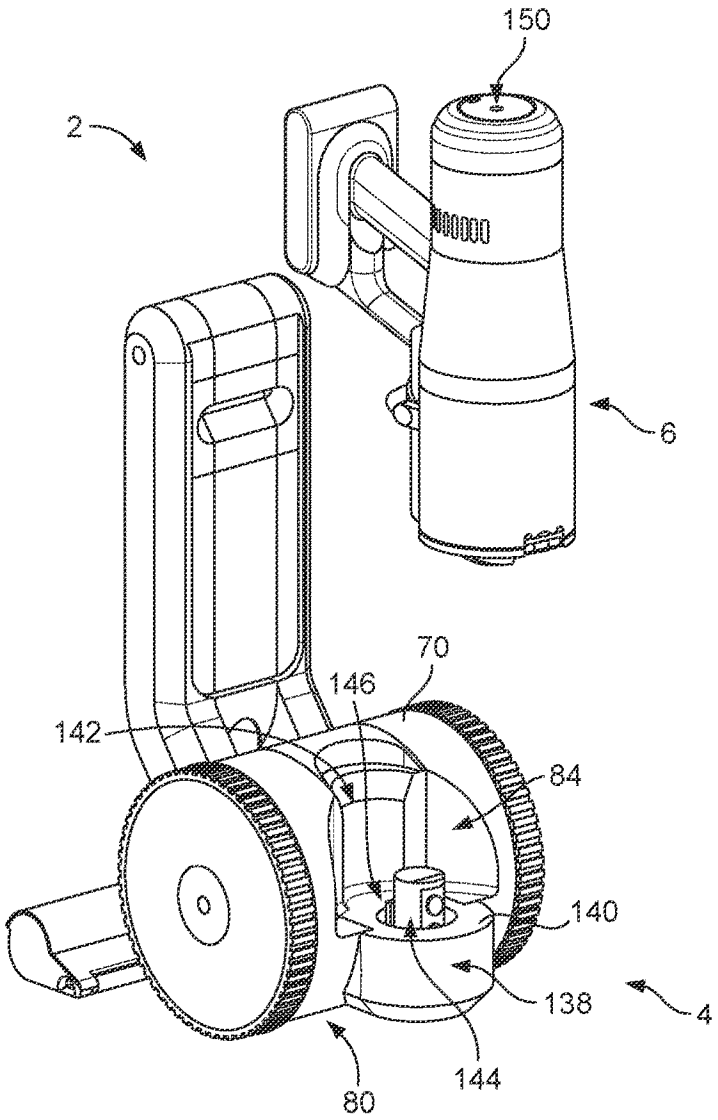
FIGS. 6*a* and 6*b* are perspective views of the vacuum cleaning system when viewed from the rear, where

The illustrated figures show a robotic vacuum cleaner 2 in accordance with an example of the invention. Referring firstly to FIGS. 1 to 3, the robotic vacuum cleaner 2 comprises two main parts. The first part is a robotic drive section, unit, or module and is labelled generally as '4' and the second part is a handheld vacuum cleaner, which is labelled generally as '6'. As will be appreciated, the handheld vacuum cleaner 6 is separable from the robotic drive module 4 such that the handheld vacuum cleaner 6 can be used on its own as a vacuum cleaning machine when it is undocked from the robotic drive module 4, or it may function together with the robotic drive module 4 to provide an autonomous vacuum cleaner system 6. As can be seen, FIGS. 1 to 3 show the robotic drive module 4 and the handheld vacuum cleaner 6 in a docked state, whilst FIG. 6*b* shows the robotic drive module 4 and in a separated or undocked state.

In this example, the machine is a vacuum cleaner, but it is also envisaged that various adaptations may be made so that it performs other surface treating functions such as mopping, polishing, sanitiser-spraying and so on. So, the cleaning system in accordance with the invention should also be considered to extend to surface treating appliances or systems. For present purposes, however, the discussion will refer to a vacuum cleaner, but it should be appreciated that the embodiments of the invention may have broader application to general surface treating functionality.

Returning to FIGS. 1 to 3, it will be appreciated that the robotic drive module 4 and handheld vacuum cleaner 6 are dockable so as to function as a self-propelled robotic vacuum cleaner. In this respect, the robotic drive module 4 provides the locomotion requirements of the machine, whilst the handheld vacuum cleaner 6 provides the suction power.

It is envisaged that each sub-unit may provide its own power, such that the robotic drive module 4 will include an on-board battery pack (not shown) to provide power to its respective drive motors (not shown), whilst the handheld vacuum cleaner 6 includes a battery pack to provide power to its on-board vacuum motor. However, it is also envisaged that power transfer between the robotic drive module 4 and the handheld vacuum cleaner 6 would be beneficial, during charging for example. Usefully, therefore, the handheld vacuum cleaner 6 can be used on its own, either in the form of a handheld vacuum cleaner or in the form of a stick-vac machine if the user wants to perform their own cleaning, for example to spot-remove debris from certain areas in the house. However, the handheld vacuum cleaner 6 can be docked onto the robotic drive module 4 such that the two machines then function as an autonomous vacuum cleaner.

At this point it should be appreciated that the robotic drive module 4 would also be provided with a suitable navigation system which would be responsible for mapping, path planning and task scheduling operations. However, this functionality is beyond the scope of this discussion and so further explanation of these aspects will be omitted.

Figure 4:
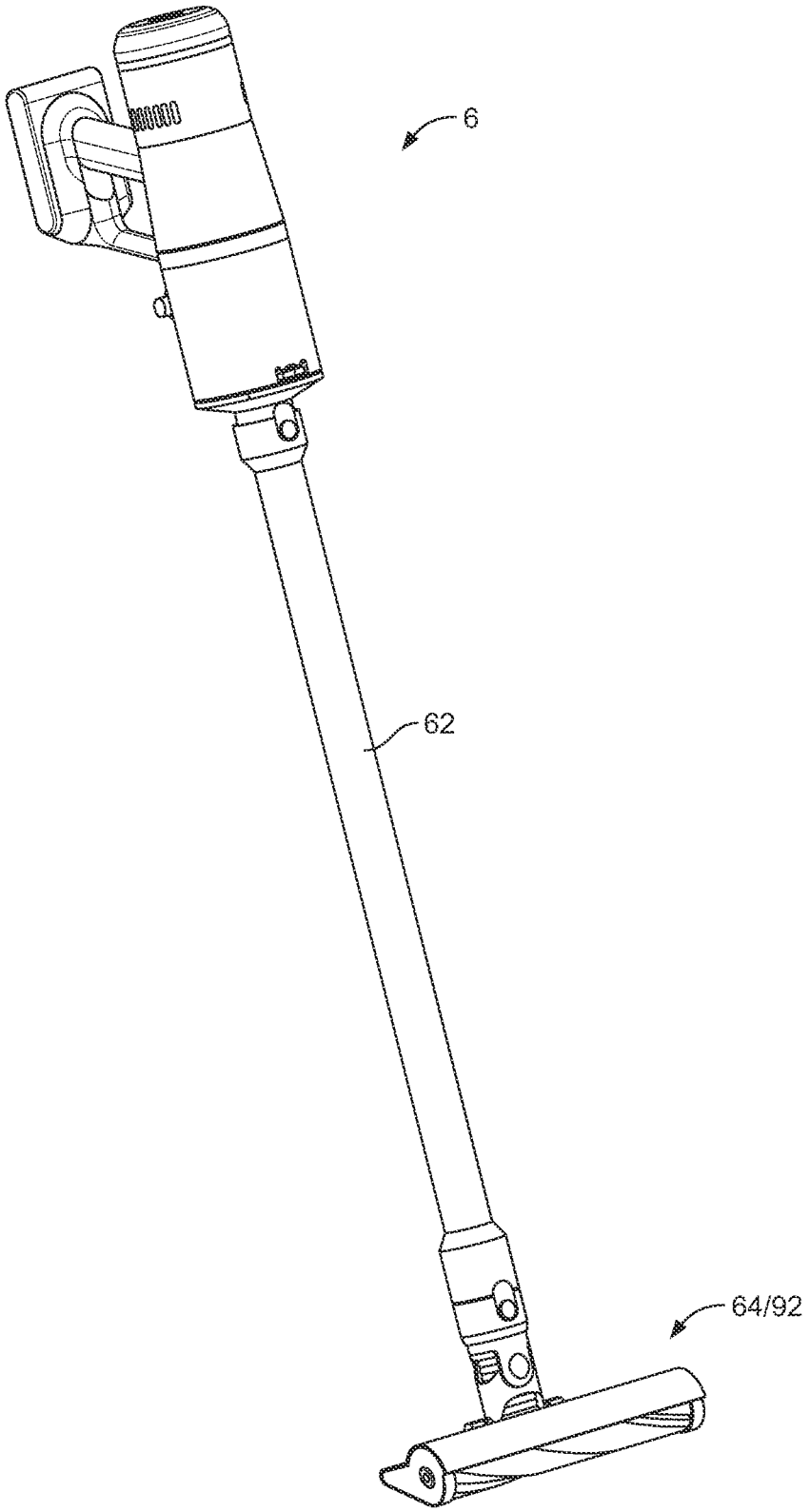
FIG. 4 shows the handheld vacuum cleaner in a stick vac configuration.
Figure 5:
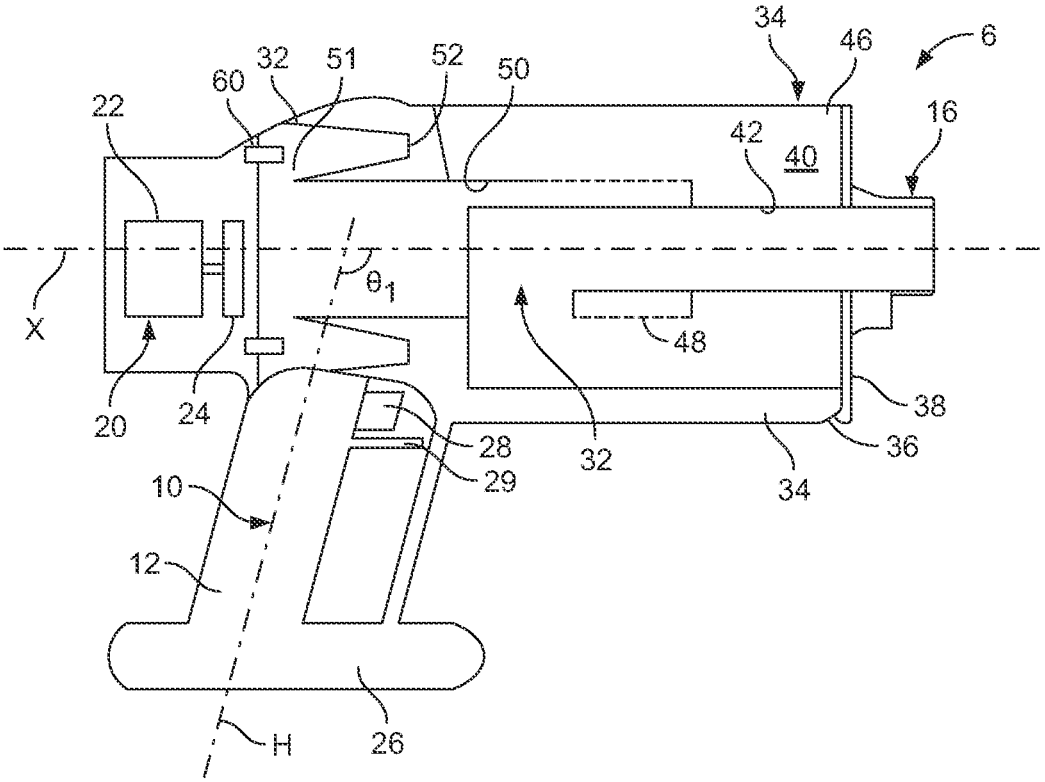
FIG. 5 is a schematic view of the handheld vacuum cleaner on its own, depicting some of its significant internal components.

With reference also to FIGS. 4 and 5, it will be noted that the handheld vacuum cleaner has a form factor of a machine currently marketed by the applicant as the Dyson V10 or V11. Although the overall form factor of the handheld vacuum cleaner 6 is therefore known in the art, a brief overview will now follow for an improved understanding.

The handheld vacuum cleaner 4 comprises a main body 10 having an elongate handle 12, a cyclonic separating unit 14 and a suction inlet 16. As shown the suction inlet 16 is formed as a short nozzle but a cleaning tool or wand extension piece could be releasably attached to the suction inlet 16 as required. The cyclonic separating unit 14 has a longitudinal axis X and extends away from the handle 12 such that the suction inlet 16 is at the end of the cyclonic separating unit 14 which is furthest from the handle 12.

The main body 10 comprises a suction generator 20 including a motor 22 and an impeller 24 which are located above and towards the rear of the handle 12. A battery 26 is located beneath the handle 12. As shown, the battery 26 is located at the end of the handle 12. The handle 12 takes the form of a pistol grip, and a trigger 28 is provided an upper end of the handle 12 for convenient operation. Optionally, and as seen here, a trigger guard 29 extends forwardly from the handle and around the front of the trigger 28. As can be seen, for ergonomic reasons, the handle 12 is generally transverse to the longitudinal axis X of the main body and extends along a handle axis H so as to form an angle $\theta_1$ therewith, which is this example is approximately 110 degrees.

The cyclonic separating unit 14 comprises a primary cyclonic separator 30 and a plurality of secondary cyclonic separators 32, which are positioned downstream from the primary cyclonic separator 30 and are arranged in a circular array about the axis X. Such a configuration is conventional in cyclonic vacuum cleaning technology. The primary cyclonic separator 30 comprises a separator body 34 in the form of a bin having a cylindrical outer wall 36 and an end wall 38, which define at least in part a cyclonic separator chamber 40. The separator chamber 40 is annular in form and extends about the longitudinal axis X. The axis of the separator chamber 40 therefore is coincident with the longitudinal axis X of the machine.

In terms of the flow path through the machine, the suction inlet 16 merges into a central duct 42 that runs centrally through the separator chamber 40, from the end wall 38, along the longitudinal axis X of the machine.

The central duct 42 terminates at a primary cyclone inlet 44 which discharges into the separator chamber 40 near to the top end of the primary cyclonic separator 30. Although not shown clearly in FIG. 5, the primary cyclone inlet 44 is angled at a tangent to the motion of air in the separator chamber 40 in use, as is conventional.

The bottom end of the separator chamber 40 near to the end wall 38 and adjacent part of the cylindrical outer wall 36 together define a dirt collector or bin 46, which serves to collect the relatively large particles that are spun out of the circumferential airflow in the separator chamber 40. The end wall 38 is pivotable with respect to the cylindrical outer wall 36 so that it can be opened to discharge collected dirt from the bin 46. It should be noted at this point that the details of the bin opening mechanism and other related details may be conventional and so further discussion on these points will be omitted. This discussion will therefore focus on the main aspects of the handheld vacuum cleaner 6.

As has been mentioned, the cyclonic separating unit 14 includes a set of secondary cyclonic separators or 'cyclones' 32 which have a geometry optimised for separating fine particles from the flow of air through the machine compared to the relative large particles for which the primary cyclonic separator 30 is optimised. Airflow transitions from the separator chamber 40 of the primary cyclonic separator 30 to the secondary cyclones 32 through a cylindrical permeable shroud 48 that extends about the exterior of the central duct 42. The shroud 48 therefore extends about the longitudinal axis X and is coaxial therewith. The shroud 48 is permeable to air, in the form of a perforated panel such as a mesh, for example, and therefore forms an air outlet from the separator chamber 40 which serves to catch fibrous material on the shroud 48.

The shroud 48 encircles a duct 50 which extends longitudinally along the machine and which defines inlets 51 to the plurality of relatively small secondary cyclones 32. In the usual way, the secondary cyclones 32 are generally conical in form and define a dirt outlet at their respective tips 52 which discharge into a fine dust collector 54. In this example, the fine duct collector 54 is defined by the outer cylindrical wall of the cyclonic separating unit 14 in a radial outward position with respect to the main dirt collector 46. In this configuration therefore, when the end wall 38 is opened, the main dirt collector 46 and the fine dust collector 54 are opened so that direct can be emptied from the machine.

In overview, during use the handheld vacuum cleaner 6 is activated by a user pressing the trigger 28 which powers up the suction generator 20. The suction generator 20 therefore establishes a negative pressure differential through the machine which draws air flow through the suction inlet 16, up the central duct 42 and into the separator chamber 40 where it rotates around the longitudinal axis X. The rotational flow in the separator chamber 40 produces a cyclonic action that separates relatively heavy or large dirty particles from the air. Due to the orientation that the handheld vacuum cleaner 6 is typically used, these large dirt particles will tend to collect in the main dirt collector 46. The partially cleaned air then passed through the shroud 48, along the duct 50 and into the secondary cyclones 32 which act to separate smaller and lighter particles of air, which are expelled through the cyclone tips 52. Clean air is drawn out of respective outlets 60 of the secondary cyclones 32 and through the suction generator 20, where it is discharged to atmosphere.

Notably, FIG. 5 shows the handheld vacuum cleaner in a 'bare' state, in which it does not have a cleaning tool attached to it. However, it should be appreciated that various cleaning attachments may be coupled to the handheld vacuum cleaner as required. In this respect, FIG. 4 shows the handheld vacuum cleaner 6 with a wand 62 attached, which turns the handheld vacuum cleaner 6 into a stick vacuum cleaner or 'stick-vac'. Here, the distal end of the wand 62 in turn has a motorised cleaner head 64 attached to it which is optimised for cleaning hard floors or other floor coverings such as carpets and rugs.

Having described the overall configuration of the handheld vacuum cleaner 6, the discussion will focus on the configuration of the robotic drive module 4. This can be seen combined with the handheld vacuum cleaner 6 in many of the drawings, but it can also be seen on its own in FIGS. 6*b* and 7.

The robotic drive module 4 comprises a main body 70 that is flanked by a pair of wheels 72, one on either side of the main body 70. The wheels 72 are circular in this example and comprise a discoidal hub 74, the perimeter of which defines or carries a traction surface 76. The traction surface 76 may be made of a different material than the hub 74 to improve traction on certain surfaces. For example, the traction surface 76 could be a band-like element made of a grippy rubberised material or similar to provide improve traction on hard floors. Although the robotic drive module 4 is provided with circular wheels in this example, it is also envisaged that another type of rolling arrangement could be provided, for example in the form of a tracked drive system. The wheels therefore should be considered to be one type of traction arrangement for the robotic drive module 4.

The wheels 72 are positioned on either side of the main body 70 and have equal diameters. As such, their outer perimeters circumscribe an imaginary cylindrical shape which defines a rolling axis 73, and within which the structure of the main body 70 is contained. More specifically, in the illustrated example, the main body 70 is barrel-like in shape with an outer diameter which is slightly smaller than the outer diameter of the wheels 62. Expressed another way, the main body 70 is generally cylindrical in form and has a diameter approximately the same as the diameter of the wheels 72, in this example.

The main body 70 can be considered to have a forward-facing side 78 and a rearward-facing side 80. The forward-facing side 78 supports a near- or proximal-end of a robotic arm 82. The rearward-face side 80 defines a docking interface, region or portion 84, and this will be described in more detail later. As can be seen, therefore, the general barrel-like shape of the main body 60 is interrupted by suitable recesses 86 for the robotic arm 70 and the docking portion 84.

Figure 7B:
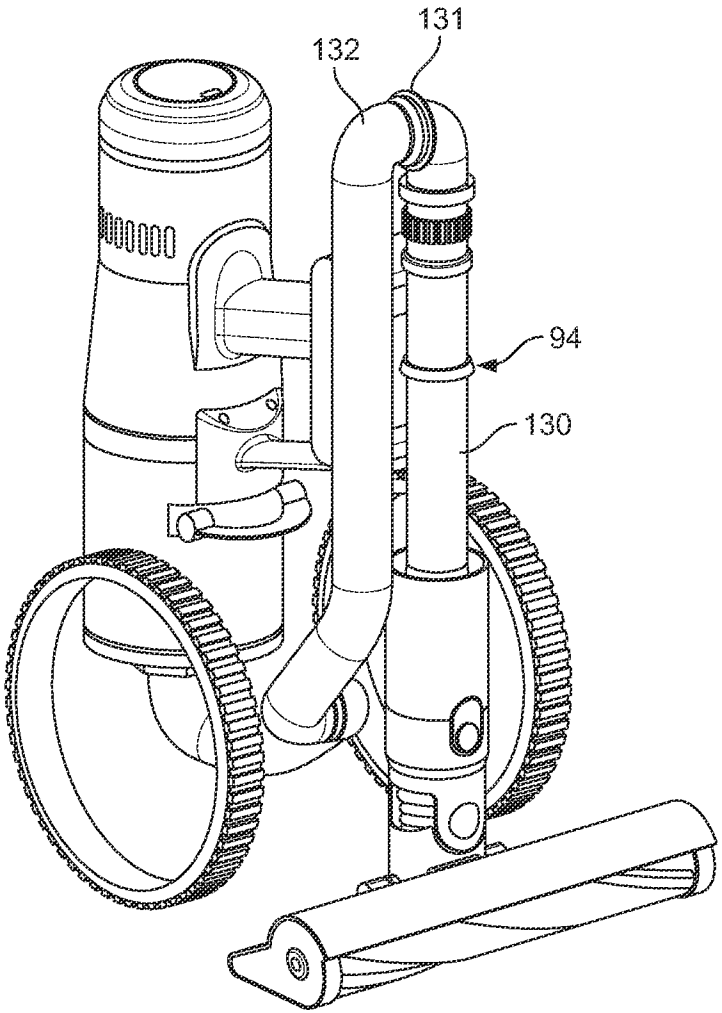
Figure 7A:
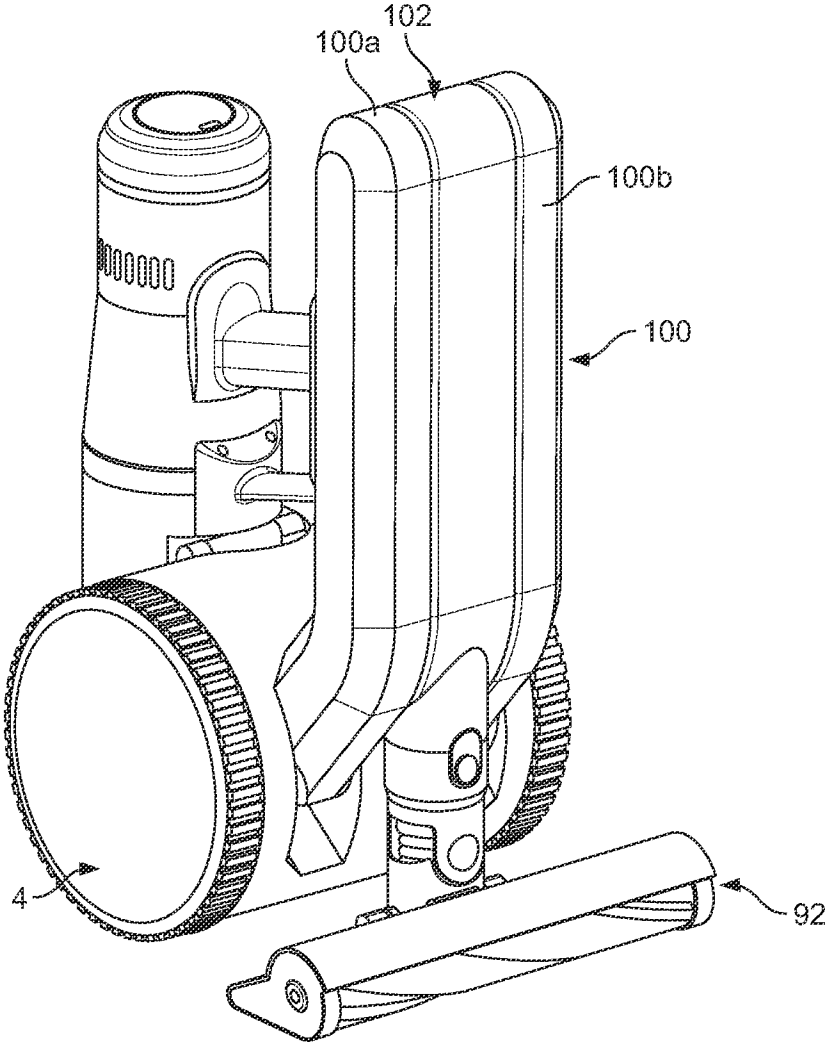

The robotic arm 82 is movable with respect to the main body 70 and includes an end effector 90 on its distal end to which different types of cleaning tools can be attached. As shown in the Figures, the end of the robotic arm 82 has a motorised cleaner head 92 attached to it. The robotic arm 82 therefore provides a suction flow path for the robotic vacuum cleaner 2 which extends from the end of the robotic arm 82, along the robotic arm 82 to the main body 70 of the robotic drive module 4 and to the handheld vacuum cleaner 6. FIGS. 7*a* and 7*b* illustrate this neatly as side-by-side views with some of the components of the machine removed so that a suction/airflow path 94 through the machine can be appreciated.

In the illustrated embodiment, the robotic arm 82 is articulated and can move between two main configuration: a stowed configuration in which the arm is folded up against the robotic drive module 4, and a deployed configuration in which in an extreme position the robotic arm extends generally straight away from the robotic drive module 4 parallel to the floor surface 101. The fully deployed configuration is shown clearly in FIGS. 2 and 3, and in FIG. 3 it will be noted that a major part of the robotic arm 82 extends parallel to the floor surface 101. In this way therefore, the robotic arm 82 takes up minimal space when in the stowed configuration since it is folded compactly against the robotic drive module 4, but it conveniently can extend in front of the robotic drive module 4 by a significant distance so it can stretch under pieces of furniture and into narrow gaps.

As shown, the robotic arm 82 comprises an upper arm portion 100 and a lower arm or 'forearm' portion 102. The upper arm portion 100 has a first end 104 that is coupled to the main body 70 and a second end 106 that is coupled to the forearm portion 102. Similarly, the forearm portion 102 includes a first end 108 that is coupled to the upper arm portion 100 and a second end 110 that defines the end effector 90.

Although the robotic arm 82 may be configured in various ways, it will be noted that in the illustrated embodiment, the upper arm portion 100 has a two-part structure such that it comprises substantially parallel arm members 100*a*, 100*b*. This provides the robotic arm 82 with a study construction and a suitable torsional rigidity that is more resistant to flexing and twisting.

The connection between the upper arm portion 100 and the main body 70 is achieved by a pair of sockets 112 defined in the main body 60 which receive respective proximal ends of the pair of upper arm members 100*a*, 100*b* to define a shoulder joint 114. Although not shown in FIGS. 1-3 the main body 70 may include a suitable drive system to pivot the upper arm portion 100 with respect to the main body 70 at the shoulder joint 114. Similarly, the distal ends of the upper arm members 100*a*, 100*b* define a yoked elbow joint 116 into which is received an end of the forearm portion 102. The elbow joint 116 is suitably configured to allow the forearm portion 102 to pivot relative to the upper arm portion 100. The two arm members or 'struts' 100*a*, 100*b* therefore are substantially parallel to one another and are each connected between the shoulder joint 114 and the elbow joint 116.

At this point it should be noted that the upper arm members 100*a*, 100*b* are parallel along the entirety of their lengths in this example. However, such a configuration is not essential and other options are possible. For example, the upper arm section 100 could comprise a single strut that engages with the main body 70 and which then forks into parallel arm sections. In such an example, the parallel arm members 100*a*, 100*b* may extend over at least 25% of the length of the upper arm section 100 between the shoulder and elbow joints 114, 116. Alternatively, the parallel arm members 100*a*, 100*b* may extend over at least 50% or even at least 75% of the length of the upper arm section 100 between the shoulder and elbow joints 114, 116.

Notably, the shoulder joint 114 and the elbow joint 116 define respective pivot axes, 114', 116'. As shown, the pivot axes 114', 116' are arranged parallel to the ground plane. As such, the pivot axes 114', 116' are also parallel to the rolling axis 73, and perpendicular to the longitudinal axis X of the handheld vacuum cleaner 6. By virtue of the parallel horizontal arrangement of the pivot axes 114', 116' the articulated arm 82 is arranged to pivot about both the shoulder joint 114 and the elbow joint 116 through a substantially vertical plane P.

The upper arm portion 100 has a dog-leg shape when viewed from the side, in this illustrated example, and so each of the upper arm members 100*a*, 100*b* comprises a first section 120 that defines a shallow angle with respect to a second section 122. This is best seen in FIG. 3, which shows clearly that a significant part of the upper arm portion 100, that is, the entirety of the second section 122 thereof, is positioned adjacent a floor surface 101 when the robotic arm 82 is in the fully deployed position. This is beneficial because it enables a significant part of the robotic arm 82 to lay flat against an adjacent floor surface 101. The first section 120 of the upper arm members 100*a*, 100*b* inclines downwardly from the shoulder joint 114 of the main body 70 and then straightens to extend parallel to the floor.

As has been mentioned, the robotic arm 82 can be folded back from its extended or deployed position, shown in FIGS. 2 and 3, to a stowed state as shown in FIG. 1. It can also be controlled to adopt positioned intermediate the two extreme positions. The two-part parallel structure of the upper arm portion 100 is beneficial in this context because it permits the lower arm section 102 to pivot around the elbow joint 116 and at least partially nest, overlap or sit between the parallel arm members 100*a*, 100*b* of the upper arm portion 100. This allows a particularly compact stowage arrangement for the robotic arm 82 in which the upper arm portion 100 and the forearm portion 102 are mutually parallel. As can be seen in FIG. 1, for example, in the stowed position the lower arm portion 102 is oriented vertically and is flanked by at least a part of the parallel upper arm members 100*a*, 100*b*, that is to say by the second sections 122 thereof. What is more, the upper extremity of the robotic arm 82 is not the highest point of the robotic vacuum cleaner 2, since despite its vertical orientation, it is lower than the vertical height reached by the upper extremity of the handheld vacuum cleaner 6, which is indicated by the line V. This can be seen clearly in FIG. 1. Expressed in another way, no part of the robotic arm 82 extends above the upper extremity of the robotic vacuum cleaner 2.

The two-part structure of the upper arm portion 100 also provides flexibility in terms of how the airflow path is routed from the cleaner head to the main body 70. For example, one of the upper arm members 100*a*, 100*b* can be configured to define the airflow path, whilst the other of the upper arm members 100*a*, 100*b* can be configured to carry the required mechanical and electrical components to power the elbow joint 116. FIGS. 7*a* and 7*b* illustrate this clearly in which a first pipe section 130 extends inside the forearm portion 102 vertically upwards from the cleaner head 92 and which bends through a 180 degree angle to form a second pipe section 132 which extends downwardly through one of the arm sections 100*a* of the upper arm portion 100 and into the main body 70 of the robotic drive module 4. Here, the first and second pipe sections 130, 132 are connected by a rotatable cuff joint 131.

As has been mentioned above, the main body 70 defines the docking portion 84 which is adapted to accept the handheld vacuum cleaner 6 in such a way as to complete the airflow path through the machine and therefore to provide a source of suction. The handheld vacuum cleaner 6 is arranged in an upright orientation with respect to the floor surface (see FIG. 3) when it is docked with the robotic drive module 4. In this way, the longitudinal axis X of the handheld vacuum clearer 6 is substantially vertical in the illustrated example.

As well as being oriented generally vertically, the handheld vacuum cleaner 6 is arranged in the docking portion 84 so that its handle 12 points in the forward direction. That is to say, the linear section of the handle 12 is aligned with a fore-aft axis F of the main body 60. As can be seen in FIGS. 1-3, the arrangement of the handheld vacuum cleaner 6 in the docking interface 84 and its orientation is such that the handle 12 extends over the top of the main body 70 of the robotic drive module 4. With respect to the floor surface/ground plane 101, the handle 12 is generally horizontal, although it should be appreciated that in the illustrated embodiment the handle 12 is not precisely horizontal but defines a small angle therewith.

As will be apparent particularly from the side views of the vacuum cleaning system 2, the handle 12 extends over the robotic drive module 4, in the fore-aft direction F, to an extent that it passes over and extends beyond the rolling axis 73 that is defined by the wheels 72. Notably, the battery 26 is located at the end of the handle 12 and, in the arrangement shown, when the handheld vacuum cleaner 6 is docked on the robotic drive module 4, the battery 26 can be considered to be in a cantilevered arrangement. As such, the battery 26 is supported on the end of the handle 12, which extends in a horizontal direction when the handheld vacuum cleaner 6 is docked on the robotic drive module 4.

Notably, the handle 12 and battery 26 have a combined length so that the end of the battery 26 is at a horizontal position which is approximately in line with the end of the wheels 72. So, the battery 26 can be considered to extend over the top of at least a part of the robotic drive module 4. Furthermore, it should be noted that the direction in which the handle 12 extends is aligned with the direction of the robotic arm 82, so as to be in parallel therewith. The handle 12 can therefore be considered to point in the forward direction of the vacuum cleaning system 2. One benefit of this arrangement is that the weight of the battery 26 provides a balancing effect, as the battery 26 is positioned on the other side of the rolling axis 73 to the main body 10 of the handheld vacuum cleaner 6. Together with the mass of the articulated arm 82, this arrangement provides a convenient means to provide balance to the twin-wheeled arrangement of the robotic drive module 4.

Figure 6A:
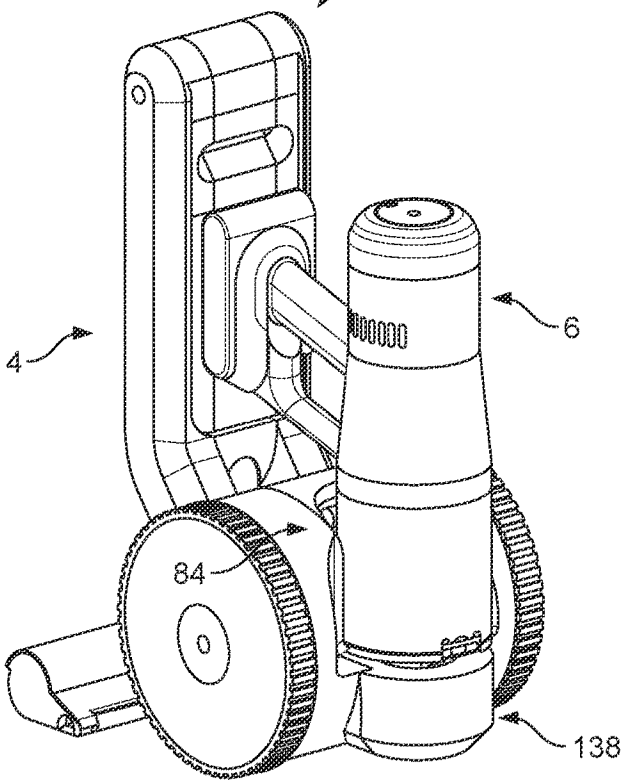

Turning now to FIGS. 6*a* and 6*b*, these Figures illustrate aspects of how the handheld vacuum cleaner 6 docks onto the robotic drive module 4. Whereas FIG. 6*a* shows the vacuum cleaning system 2 with the handheld vacuum cleaner 6 docked onto the robotic drive module 4, FIG. 6*b* show the robotic drive module 4 on its own.

The docking portion 84 takes the form of a recess defined in the rear side 80 of the main body 70 of the robotic drive module 4, and comprises a base section 140 and a curved wall 142.

The curved wall 142 is shaped to match approximately the circular geometry of the bin of the handheld vacuum cleaner 6. As a result, the handheld vacuum cleaner 6 appears to partially 'sit' in the robotic drive module 4 in a piggy-back configuration. The base section 140 is generally circular in shape and defines a generally flat annular platform 143 for receiving the leading end of the bin of the handheld vacuum cleaner 6.

As can be seen in FIG. 6*b*, an airflow connector 144 is defined at the centre of the floor 140 of the docking region 84 and this airflow connector 144 is configured to mate with the suction inlet 16 of the handheld vacuum cleaner 6. Likewise, situated next to the airflow connector 144 is an electrical connector 146 which is configured to be mated with a respective electrical connector 148 of the handheld vacuum cleaner 6.

Whereas the airflow connector 144 completes the airflow path through the machine, from the cleaner head 92, along the robotic arm 82 into the main body 70, through the docking portion 84 and finally to the handheld vacuum cleaner 6, the electrical connector 146 may provide power and/or data transfer between the robotic drive module 4 and the handheld vacuum cleaner 6. For example, in terms of electrical power, it is an option for the main body 70 to accommodate a larger battery system than the handheld vacuum cleaner 6 so it may be advantageous to enable the robotic drive unit 4 to power the handheld vacuum cleaner 6. Similarly, when the vacuum cleaning system 2 is docked to an appropriate ground-based docking station for the purposes of charging, the handheld vacuum cleaner 6 may be charged through the robotic drive module 4.

Turning now to FIGS. 8*a-c*, and FIGS. 9 to 13, the discussion will focus more specifically on the functionality of the robotic arm 82.

Figure 8C:
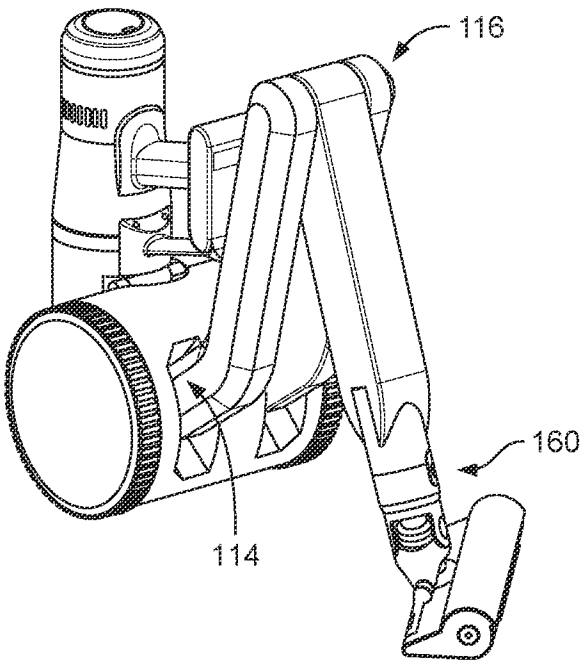
FIG. 8*a-c* show three comparative views of the vacuum cleaning system which emphasise the functionality of the articulated arm, and particularly the ability of the arm to twist and steer.
Figure 8B:
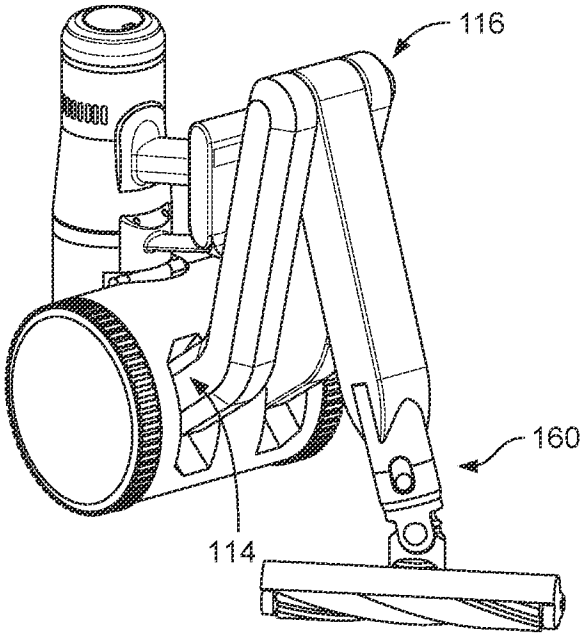
Figure 8A:
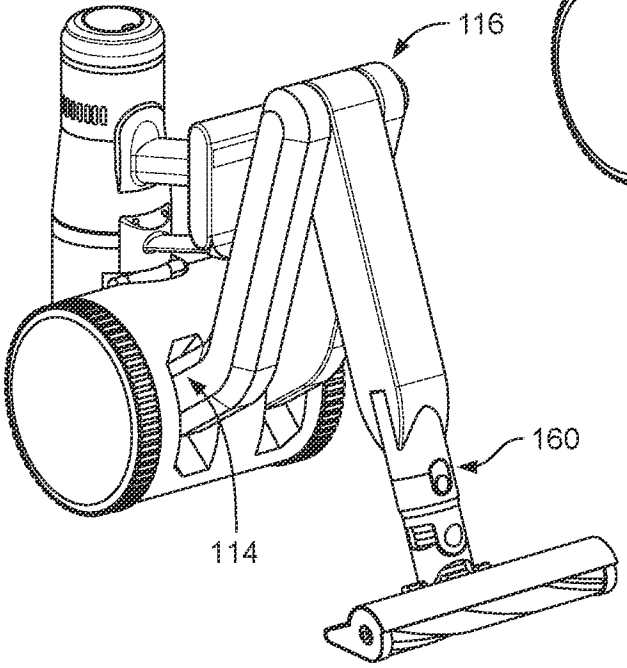

The preceding discussion explains that the robotic arm 82 is articulated about its parallel shoulder joint 114 and elbow joint 116 so that it is able to deploy outwardly from the main body 70 of the robotic drive module 4 to improve the reach of the vacuum cleaner. FIGS. 8*a-c* show the vacuum cleaning system 2 where the robotic arm 82 has been deployed to an intermediate state but notably shows further functionality. In addition to the rotatable shoulder joint 144 and elbow joint 116, the robotic arm 82 also includes a rotatable wrist point 160. This can be particularly useful in allowing the vacuum cleaning system 2 to steer itself about the floor surface. Notably, the action of the wrist joint 160 means that the end effector 90 rotates around a wrist axis 160' which is aligned with the major axis of the forearm portion 102, and which is perpendicular, in this example, to the axis 116' of the elbow joint 116. FIG. 8*b* illustrates the wrist joint 160 rotating to the right, with respect to the robotic drive module 4, which assists in steering the robotic drive module 4 in that direction and, in contrast, FIG. 8*c* shows the wrist joint 160 steering to the left with respect to the robotic drive module 4. It should be noted that the floor surface is not shown in these figures, but its presence is implied.

The shoulder joint 114 and the elbow joint 116 may be driven by their own individual drive motors. However, other options are possible. For example, one possibility is that a single drive motor could be located at the elbow joint 116 and that this would enable the elbow joint 116 to extends and retract, thereby also driving the shoulder joint 114. In this respect, the elbow joint 116 would be an active joint because it is driven by its respective drive motor, whereas the shoulder joint 114 would be a passive joint 114 because although it is free to rotate, it would not be actively driven.

Figure 9:
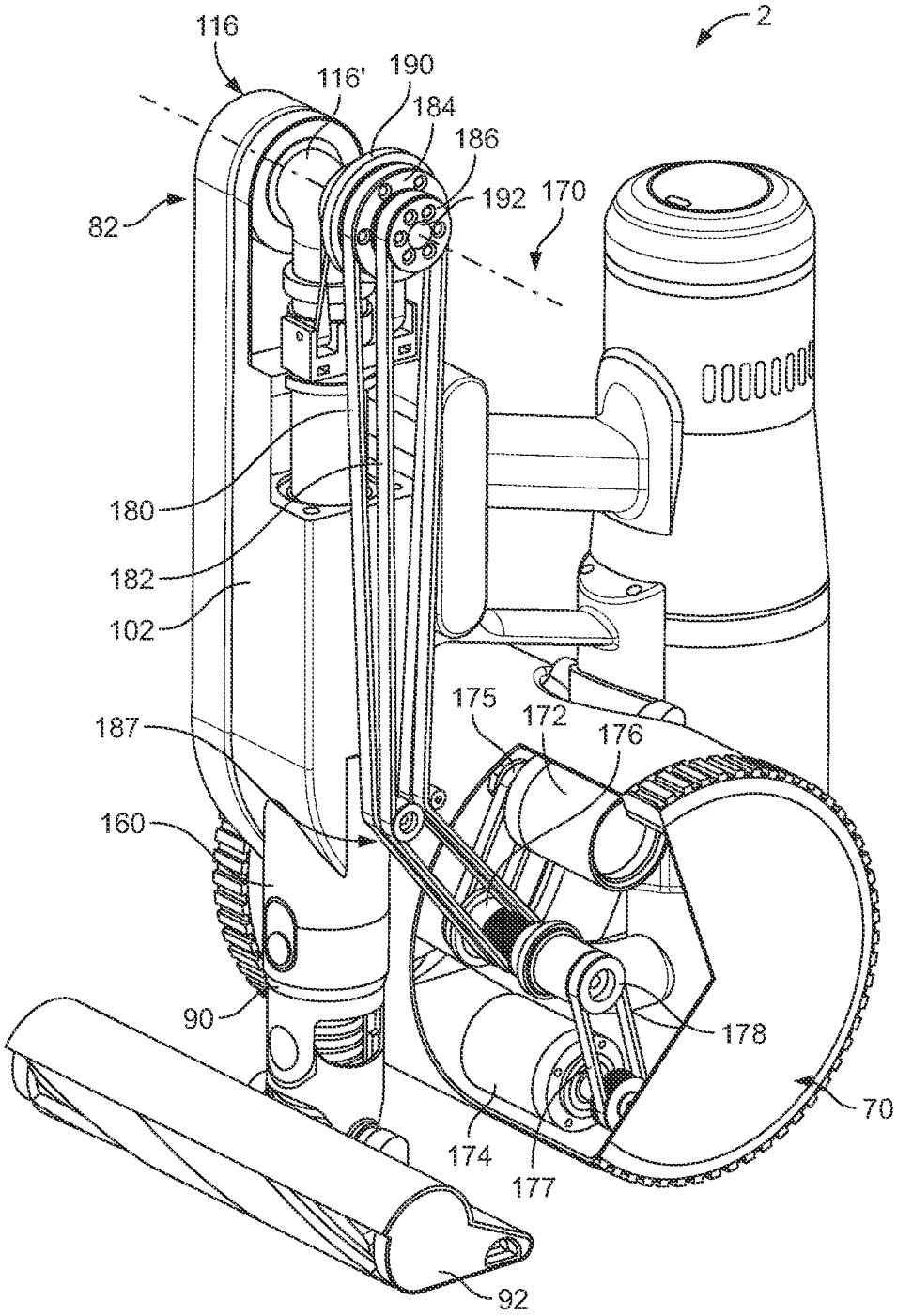
FIGS. 9 and 10 are partial cut away views of the vacuum cleaning system, from different viewing perspectives, which show in more detail a drive mechanism associated with the articulated arm.
Figure 10:
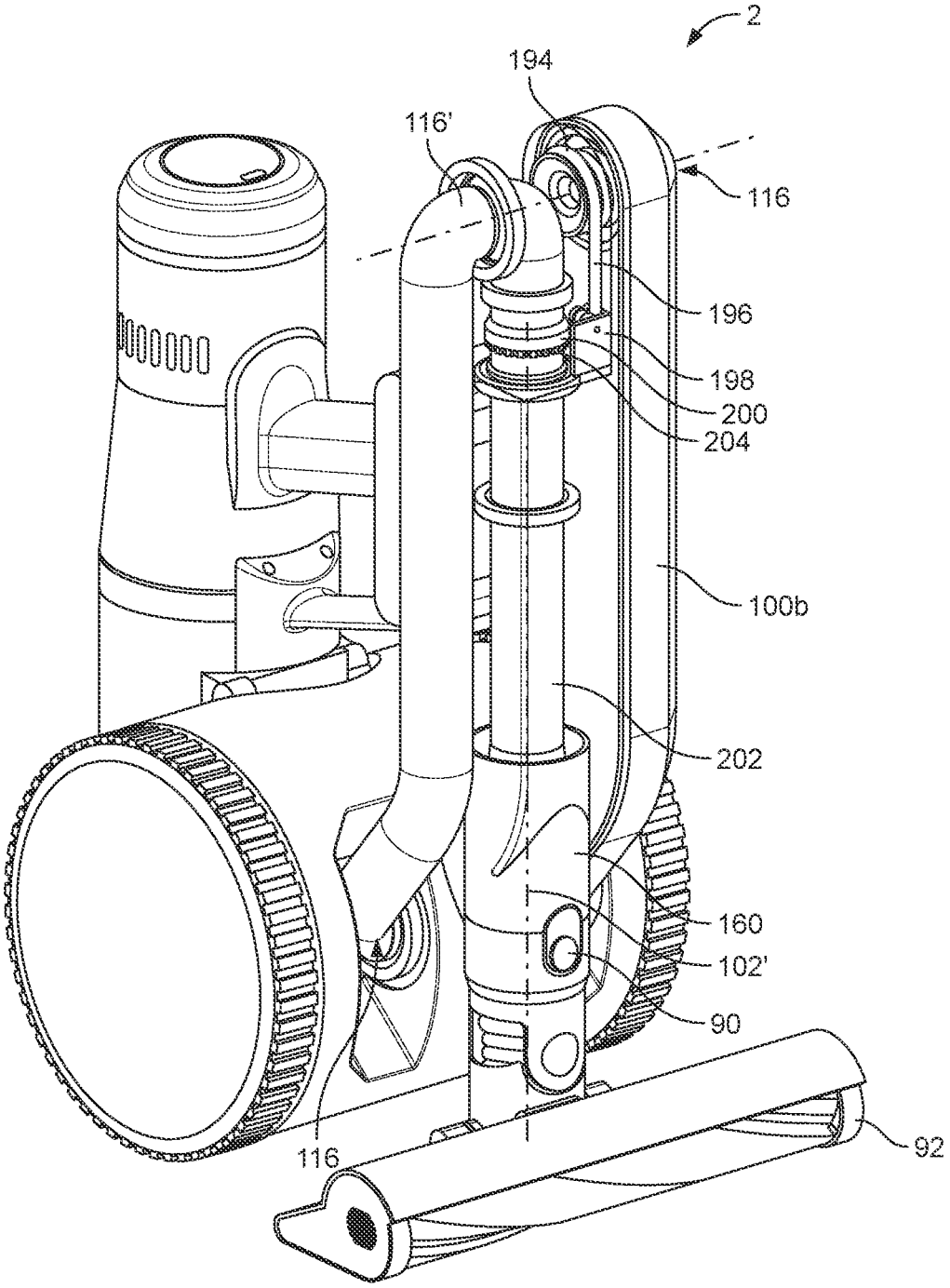

FIGS. 9 and 10 show an example of an approach to provide a drive mechanism for the robotic arm 82, which is indicated generally as 170. As discussed, the drive mechanism 170 is arranged to drive the elbow joint 116 which, in turn, causes the upper arm portion 100 to pivot about the shoulder joint 114. The drive mechanism 170 is also arranged to drive the wrist joint 160, as will be explained.

In overview, the drive mechanism 170 comprises first and second drive motors 172, 174 each of which drives a respective axle 176, 178. In the illustrated example, the drive motors 172, 174 are both housed within the main body 70. It is envisaged that the drive motors 172, 174 could be directly arranged so that the spindles of the motors are in line with the drive axles. However, for convenience of packaging, here the drive motors 172, 174, are connected to the respective drive axles 176, 178 via short drive loops 175, 177.

The drive axles 176, 178 are also housed within the main body 70 in this example, and are shown here as being mounted coaxially for convenience, although they are free to rotate independently from one another.

The drive axles 176, 178 are each configured to cooperate and drive a respective transmission in the form of drive linkages 180, 182. The drive linkages, members or 'belts' 180, 182 extend away from the main body 70 and link to respective drive sprocket 184, 186 located at the elbow joint 116.

Although not shown in FIG. 9, the drive belts 180, 182 extend from the main body 70 along the right-hand section 100*b* of the upper arm portion 100. Since FIG. 9 is a cut-away view, the housing of the upper arm section 100*b* is not shown in the figure, instead exposing the drive belts. In order to guide the drive belts 180, 182 along the dog-leg shape of the upper arm portion 100, a suitable drive belt tensioner 187 is provided about a third of the way along the travel of the drive belts 180, 182. Note that the internals of the main body 70 are simplified here such that components not relevant to the discussion are not shown, for ease of illustration and understanding.

As can be see in FIGS. 9 and 10, drive sprockets 184, 186 are located at the elbow joint 116 but serve different functions. Taking each drive sprocket in turn. The first drive sprocket 184 is located on the left-hand side in FIG. 9 and links to the first drive belt 180. The first drive sprocket 184 is larger than the second drive sprocket 186, in this example, but the relative size difference is simply due to the required gearing that is required between the drive motors, drive axles and drive sprockets. The first drive sprocket 184 is connected of otherwise drivably associated with a drive ring 190 through which means rotational torque is transmitted from the first drive sprocket 184 to the to forearm portion 102. This may be by means of a toothed or splined engagement between the drive ring 190 and the forearm portion 102 which is not shown in the figures but which would be understood by the skilled person. Therefore, operation of the first drive motor 172 drives the first drive belt 180 via the respective drive axle 176, which therefore drives the first sprocket 184 which pivots the forearm portion 102 about the axis 116' of the elbow joint 116. Since the mass of the cleaner head 92 keeps the robotic arm 82 grounded, extension of the elbow joint 116 causes the robotic arm 82 to extend therefore pushing the cleaner head 92 across the floor.

Whereas the first drive sprocket 184 drives the angular extension of the forearm portion 102, the second drive sprocket 186 serves a different function. More specifically, the second drive sprocket 186 drives both the angular rotation of the wrist joint 160, but also enables the end effector 90 to extend linearly with respect to the forearm portion 102.

The forearm portion 102 is shown in more detail in FIGS. 11, 12 and 13, and reference will now be made also to these figures in order to describe the kinematics of the wrist joint 160 in more detail.

Turning to the rotatable wrist joint 160, as has been explained above this is operated by the second drive motor 174, which connects to the second drive sprocket 186 via the second drive axle 178 and the second drive belt 182. Although it cannot be seen by FIG. 9, what can be appreciated better in FIG. 10 is that the second drive sprocket 186 is coupled to an axle 192 that extends through the first, relatively large, drive sprocket 184 and terminates in a slave sprocket 194. The slave sprocket 194 is associated with a further drive belt 196 which has a first end that is looped over the slave sprocket 194, and which then passes through a right-angled guide 198 and has a second end looped over a further slave sprocket 200 which is mounted to a rotatable air pipe 202 of the forearm portion 102. As can be viewed in FIG. 10, the rotatable air pipe 202 is connected to the end effector 90 of the forearm portion 102 and, thus, the cleaner head 92. Therefore, rotation of the second drive motor 174 drives the second drive belt 182 via the second drive axle 178, which then causes the air pipe 202 to rotate which therefore 'steers' the cleaner head 92, in a manner shown in FIGS. 8*a-c*.

In addition to causing the end effector 90 to rotate about the major axis of the forearm portion 102, the second drive belt 182 is also operable to cause the end effector 90 to extend and retract linearly along the major axis 102' of the forearm portion 102.

Figure 11:
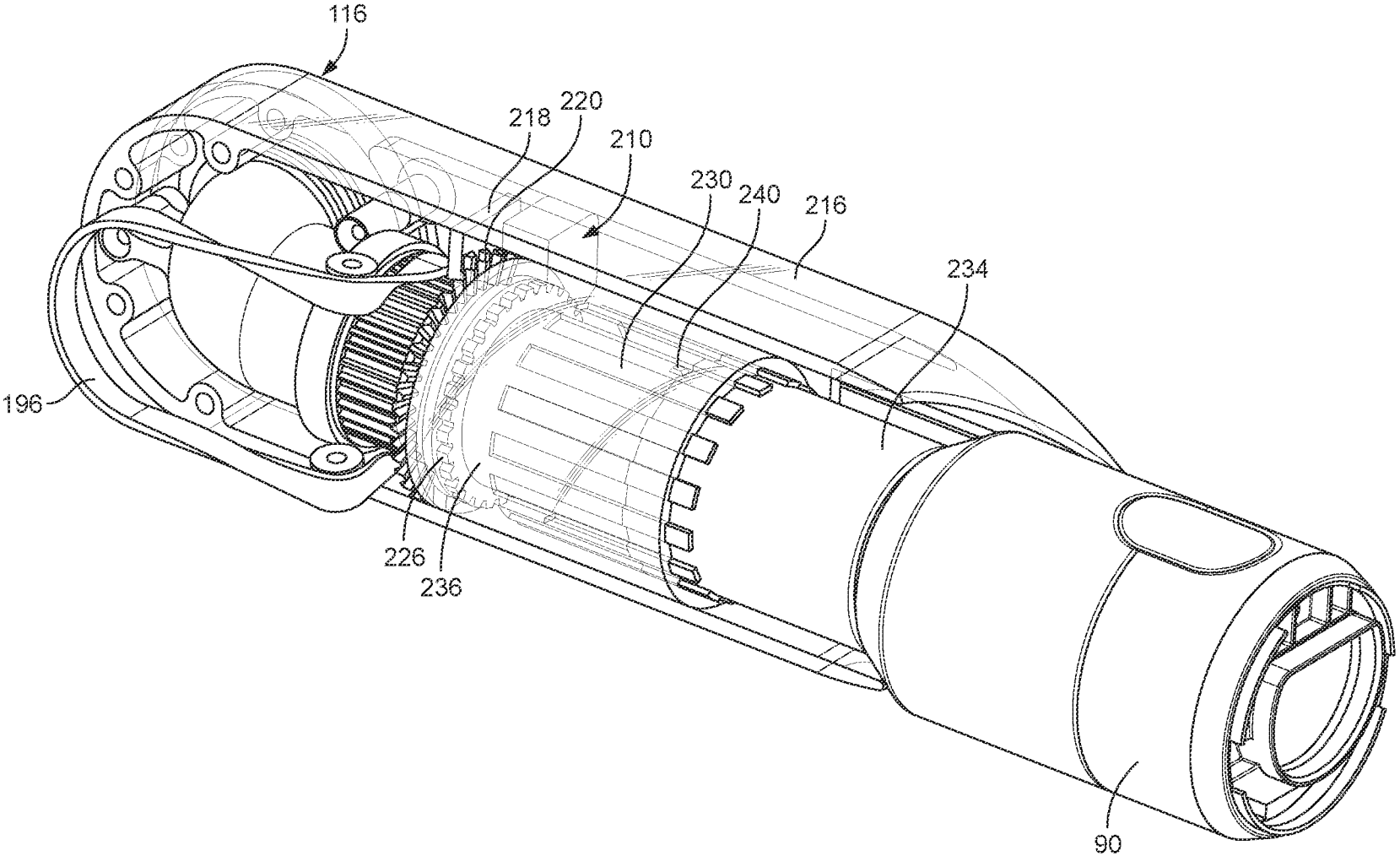
FIG. 11 is a perspective view of a forearm portion of the articulated arm to show hidden detail.
Figure 12:
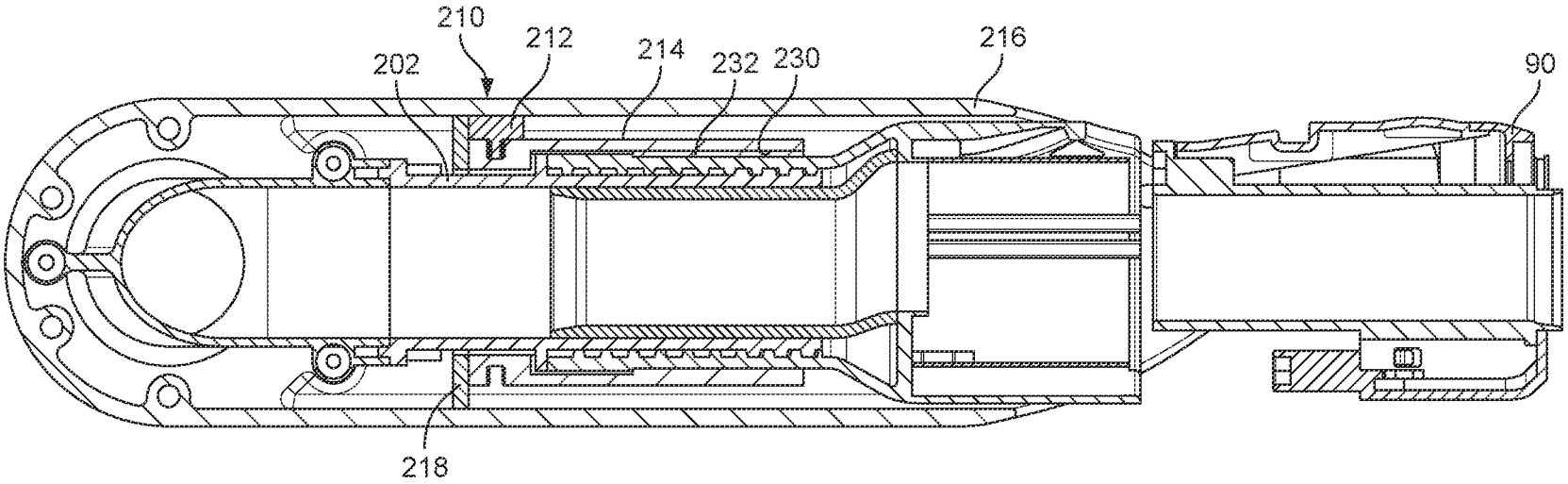
FIGS. 12 and 13 are side views along the forearm portion which show internal components during modes of operation of the forearm portion.

FIG. 11 shows a perspective view of the forearm portion 102 and there can be seen the drive belt 196 which passes through the right-angled guide 198 as seen in FIG. 10, and engages with a toothed drive section 204 of the rotatable air pipe 202, such that rotation of the toothed drive section 204 also rotates the end effector 90.

However, the forearm portion 102 also comprises a drive switch system 210. In overview, the drive switch system 210 comprises a clutch mechanism 212 and an outer guide sleeve 214. The clutch mechanism 212 is coupled to the outer guide sleeve 214 so as to exert control over its axial position with respect to the rotatable air pipe 202. Although not shown here, it should be appreciated that the clutch mechanism 212 may be electromagnetically controlled, as would be understood by the skilled person.

The purpose of the clutch mechanism 212 is to control the position of the guide sleeve 214 and, in doing so, control whether the guide sleeve 214 is able to rotate with the rotatable air pipe 202 or whether the guide sleeve 214 is fixed relative to forearm portion 102 and, more specifically, an outer casing 216 thereof.

The guide sleeve 214 has two main positions. The first position is shown in FIG. 12, in which it can be see that the clutch mechanism 212 in shifted to the left when compared to the position in FIG. 13 where it has shifted to the right. In the first position, the clutch mechanism 212 pulls the end of the guide sleeve 214 towards a wall or bulkhead 218 of the forearm casing 216. The wall defines a radial ribbed formation 220 on its axial surface with which the end 222 of the guide sleeve 214 can engage. Therefore, when the guide sleeve 214 is pulled by the clutch mechanism 212 into the first position, the guide sleeve 214 intermeshes with the radial ribbed formation 220 which interlocks the guide sleeve 214 to the forearm casing 216.

Figure 13:
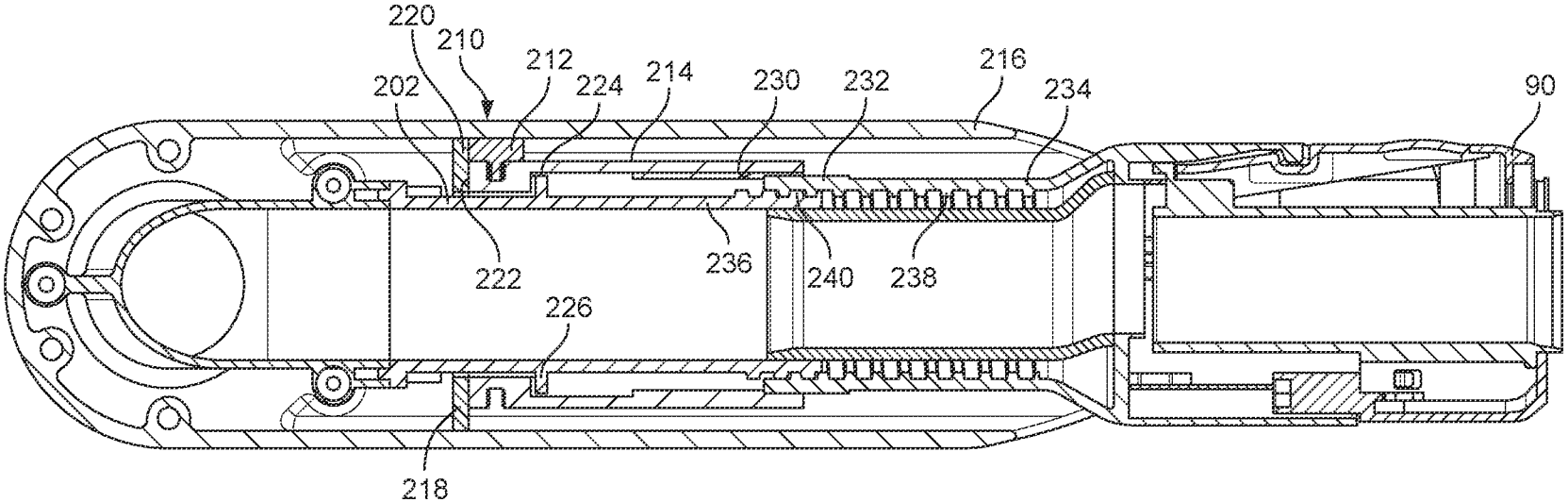

Conversely, when the clutch mechanism 214 shifts the guide sleeve 214 to the right, that is, to the second position as seen in FIG. 13, the guide sleeve 214 is free to rotate. In fact, the guide sleeve 214 has an internally notched surface 224 that mates with a set of radial teeth 226 provided on the rotating pipe 202. Rotation of the rotatable pipe 202 is therefore locked to the guide sleeve 214.

As can be seen in FIG. 11, the internal surface of the guide sleeve 214 defines circumferentially-spaced linear splines 230 which corporate with corresponding linear ribs 232 defined on the outer surface of a telescoping or extensible section 234 of the rotatable air pipe 202. The telescoping section 234 of the rotatable air pipe 202 cooperates with a non-telescoping section 236. In the illustrated example, the non-telescoping section 236 is fixed relative to the forearm, and is located proximal to the elbow joint 116 whereas the telescoping section 234 is located distal from the elbow joint 116.

The telescoping section 234 defines an internal thread 238 which cooperates with an external thread 240 defined on the outer surface of the distal end of the non-telescoping section 236.

Therefore, when the non-telecoping section 236 is driven to rotate, and whilst the guide sleeve 214 is held static with respect to the outer casing 216, the telescoping section 234 is guided by the guide sleeve 214 through linear motion. This is apparent in FIG. 13 as the end effector 90 is shown in a relatively extended axial position relative to its position in FIG. 12.

So, it will be apparent from the above, that through the use of a single drive motor, the forearm portion can conveniently be controlled to rotate, thus being able to steer the cleaner head attached to it, but also to extend, therefore making it possible to further extend the reach of the robotic arm.

Various modifications to the illustrated examples are possible without departing from the scope of the invention as defined by the claims.

The invention claimed is:

1. A vacuum cleaning system comprising:

a robotic unit comprising a main body, a traction arrangement defining a ground plane, and an articulated arm, wherein the articulated arm comprises an upper arm section and a lower arm section, wherein the upper arm section is attached to the main body at a shoulder joint, and wherein the lower arm section is attached to the upper arm section at an elbow joint, and an end effector is defined at a distal end of the lower arm section, wherein the upper arm section comprises a pair of generally parallel arm members which are connected between the shoulder joint and the elbow joint and which are configured to define a yoke at the elbow joint at which the lower arm section is connected, wherein the pair of generally parallel arm members of the upper arm section each comprise a first longitudinal section and a second longitudinal section, the first longitudinal section being angularly offset from the second longitudinal section by a nonzero angle such that the pair of generally parallel arm members of the upper arm section are non-linear along the length, and wherein the second longitudinal sections are capable of being oriented substantially adjacent to the ground plane.

2. The vacuum cleaning system of claim 1, wherein the pair of parallel arm members extend over at least 25% of the length of the upper arm section between the elbow joint and the shoulder joint.

3. The vacuum cleaning system of claim 1, wherein the pair of parallel arm members extend over at least 50% of the length of the upper arm section between the elbow joint and the shoulder joint.

4. The vacuum cleaning system of claim 1, wherein the pair of parallel arm members extend over at least 75% of the length of the upper arm section between the elbow joint and the shoulder joint.

5. The vacuum cleaning system of claim 4, wherein the pair of parallel arm members comprises two struts, each of which has a first end connected to the shoulder joint of the robotic unit and a second end that together defines the yoke at the elbow joint.

6. The vacuum cleaning system of claim 1, wherein the pair of parallel arm members extend over substantially the entire length of the upper arm section between the elbow joint and the shoulder joint.

7. The vacuum cleaning system of claim 1, further comprising a drive mechanism configured to cause to articulated arm to pivot at the elbow joint.

8. The vacuum cleaning system of claim 7, wherein the drive mechanism comprises a transmission that extends at least in part along one of the parallel arm members.

9. The vacuum cleaning system of claim 8, wherein a suction conduit extends at least in part along the other of the parallel arm members.

10. The vacuum cleaning system of claim 7, wherein the drive mechanism includes a drive motor located at the main body of the robotic unit and configured to control the movement of the elbow joint by way of the transmission.

11. The vacuum cleaning system of claim 7, wherein the drive mechanism is further configured to drive movement of the end effector.

12. The vacuum cleaning system of claim 1, wherein a portion of the lower arm section is located substantially between the pair of parallel arm members of the upper arm section when the articulated arm is in a stowed position.

13. The vacuum cleaning system of claim 12, wherein in the stowed position the parallel members extend substantially vertically with respect to the ground plane defined by the traction arrangement.

14. The vacuum cleaning system of claim 12, wherein the articulated arm is movable from the stowed position to a fully deployed position, wherein in the fully deployed position the lower arm section extends substantially parallel to the ground plane.

15. The vacuum cleaning system of claim 14, wherein in the fully deployed position a portion of the upper arm section extends substantially parallel to the ground plane.

* * * * *